US006169255B1

(12) United States Patent
Tsai et al.

(10) Patent No.: US 6,169,255 B1
(45) Date of Patent: Jan. 2, 2001

(54) FLEXIBLE MEMBRANE CIRCUIT STRUCTURE FOR KEYSWITCH

(75) Inventors: Ching Cheng Tsai, Keelung; Wen To Chou, Taipei Hsien, both of (TW)

(73) Assignee: Chicony Electronics Co., Ltd., Taipei Hsien (TW)

( * ) Notice: Under 35 U.S.C. 154(b), the term of this patent shall be extended for 0 days.

(21) Appl. No.: 09/393,974

(22) Filed: Sep. 10, 1999

(51) Int. Cl.[7] ..... H01H 13/70
(52) U.S. Cl. ..... 200/5 A; 200/5.7
(58) Field of Search ..... 200/5 A, 5.2, 5.7, 200/341, 342–345; 400/472, 473, 477, 479, 490–496; 361/680

(56) References Cited

U.S. PATENT DOCUMENTS 4,450,324 * 5/1984 Fukukura et al. ..... 200/5 A
4,837,412 * 6/1989 Tachibana ..... 200/5 A
4,901,193 * 2/1990 Kinugawa et al. ..... 361/212
6,057,517 * 5/2000 Meyer ..... 200/5 A

* cited by examiner

*Primary Examiner*—Michael Friedhofer
(74) *Attorney, Agent, or Firm*—Rosenberg, Klein & Lee

(57) ABSTRACT

A flexible membrane circuit structure for keyboard comprises a substrate; a membrane circuit structure arranged on the substrate and comprising an upper membrane layer and a lower circuit layer, a plurality of movable keytops depressibly arranged on the substrate and each corresponding to one the conductive contact; at least one fixed keytop arranged on marginal location of the keyboard and being not depressible. Each membrane circuit layer has conductive contacts. The conductive contacts on the upper membrane layer has a predetermined separation with corresponding conductive contacts on the lower membrane layer. The upper membrane layer and the lower circuit layer is bridged by at least one folded plate such that the upper membrane layer electrically and mechanically connected with the lower circuit layer. The folded plate received within the fixed keytop to prevent the breaking of the folded plates.

6 Claims, 6 Drawing Sheets

FLEXIBLE MEMBRANE CIRCUIT STRUCTURE FOR KEYSWITCH

FIELD OF THE INVENTION

The present invention relater to a flexible membrane circuit structure for keyswitch, especially to a flexible membrane circuit structure for low-profile keyswitch, by which the cost is reduced and the endurance is enhanced.

BACKGROUND OF THE INVENTION

The portable electronic apparatus such notebook computer, electronic dictionary and PDA generally use low-profile keyboard to enhance the portability thereof These low-profile keyboards generally uses flexible membrane circuit with single layer, double layer or triple layer structure to minimize the height thereof. In the flexible membrane circuit with double layer or triple layer structure, there are an upper membrane circuit layer and a lower membrane circuit layer each with a plurality of conductive contacts corresponding to the location of the keyswitch to be assembled on the upper membrane circuit and the lower membrane circuit. More particularly, in the flexible membrane circuit with double layer structure, a circular spacer is arranged around one conductive contact on the upper or lower membrane circuit layer. In the flexible membrane circuit with triple layer structure, a spacer layer with a plurality of through holes each corresponding to one conductive contact is sandwiched between the upper and lower membrane circuit layer. However, in the flexible membrane circuit with double layer or triple layer structure, the upper and lower membrane circuit layer with printed circuit thereon are separately formed and then the upper and lower membrane circuit layer with printed circuit are assembled. The manufacture is complicated and the cost is high.

As shown in FIG. 1 and FIG. 1A, the above-mentioned problem can be solved by using a larger flexible membrane circuit layer composed of two upper membrane circuit layers bridged by a plurality of folded plates 12. Therefore, the area of the larger flexible membrane circuit layer is about two times of an upper membrane circuit layer 10 or a lower membrane circuit layer 11 in previously-described keyboard. The circuit trace is formed on the surface of the larger flexible membrane circuit and then the larger flexible membrane circuit is folded by bending the folded plates 12 such that a connected upper membrane circuit layer 10 and lower membrane circuit layer 11 is formed. Moreover, a spacer layer 13 can be provided between the upper membrane circuit layer 10 and the lower membrane circuit layer 11. However, when assembled in a keyboard 1, the folded plates 12 are arranged on the edge of the keyboard 1 and between the movable keytop 14 and the substrate 15 of the keyboard 1. As shown in FIGS. 2 and 3, the folded plates 12 are subjected to repeated striking force of the movable keytop 14 such that the bent portion 120 of the folded plate 12 is probably broken.

It is an object of the present invention to provide a flexible membrane circuit structure for low-profile keyswitch, by which the above mentioned problems are solved, and the keyboard cost is reduced.

To achieve above objects, the present invention provides a flexible membrane circuit structure for keyboard comprising a substrate; a membrane circuit structure arranged on the substrate and comprising an upper membrane layer and a lower circuit layer, a plurality of movable keytops depressibly arranged on the substrate and each corresponding to one the conductive contact; at least one fixed keytop arranged on marginal location of the keyboard and being not depressible. Each membrane circuit layer has conductive contacts. The conductive contacts on the upper membrane layer has a predetermined separation with corresponding conductive contacts on the lower membrane layer. The upper membrane layer and the lower circuit layer is bridged by at least one folded plate such that the upper membrane layer electrically and mechanically connected with the lower circuit layer. The folded plate received within the fixed keytop to prevent the breaking of the folded plates.

The various objects and advantages of the present invention will be more readily understood from the following detailed description when read in conjunction with the appended drawing, in which:

DETAIL DESCRIPTION OF PREFERRED EMBODIMENT

Figure 1:
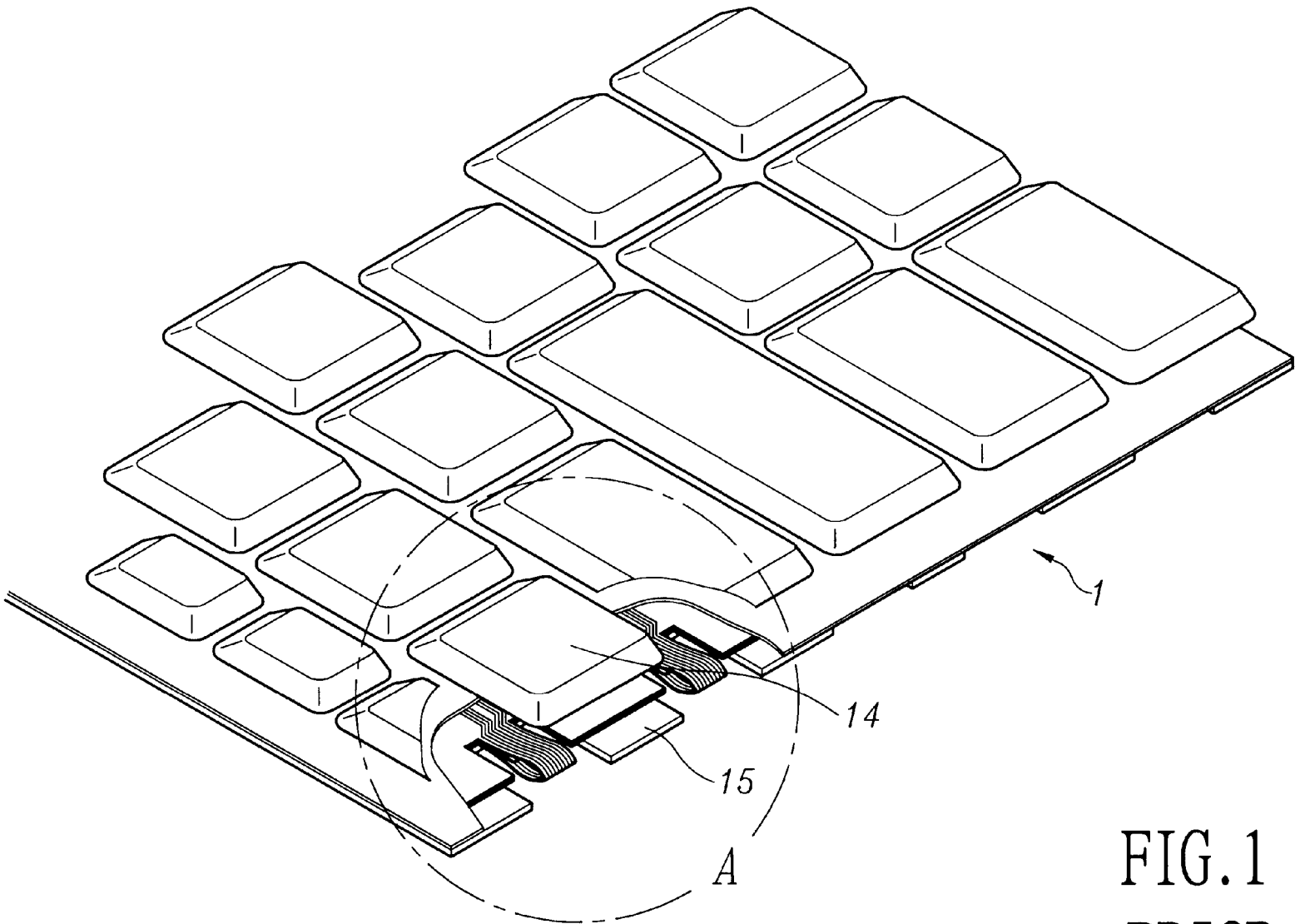
FIG. 1 PRIOR ART
FIG. 1 is a partial perspective view of a flexible membrane circuit structure in a conventional low-profile keyswitch.
Figure 1A:
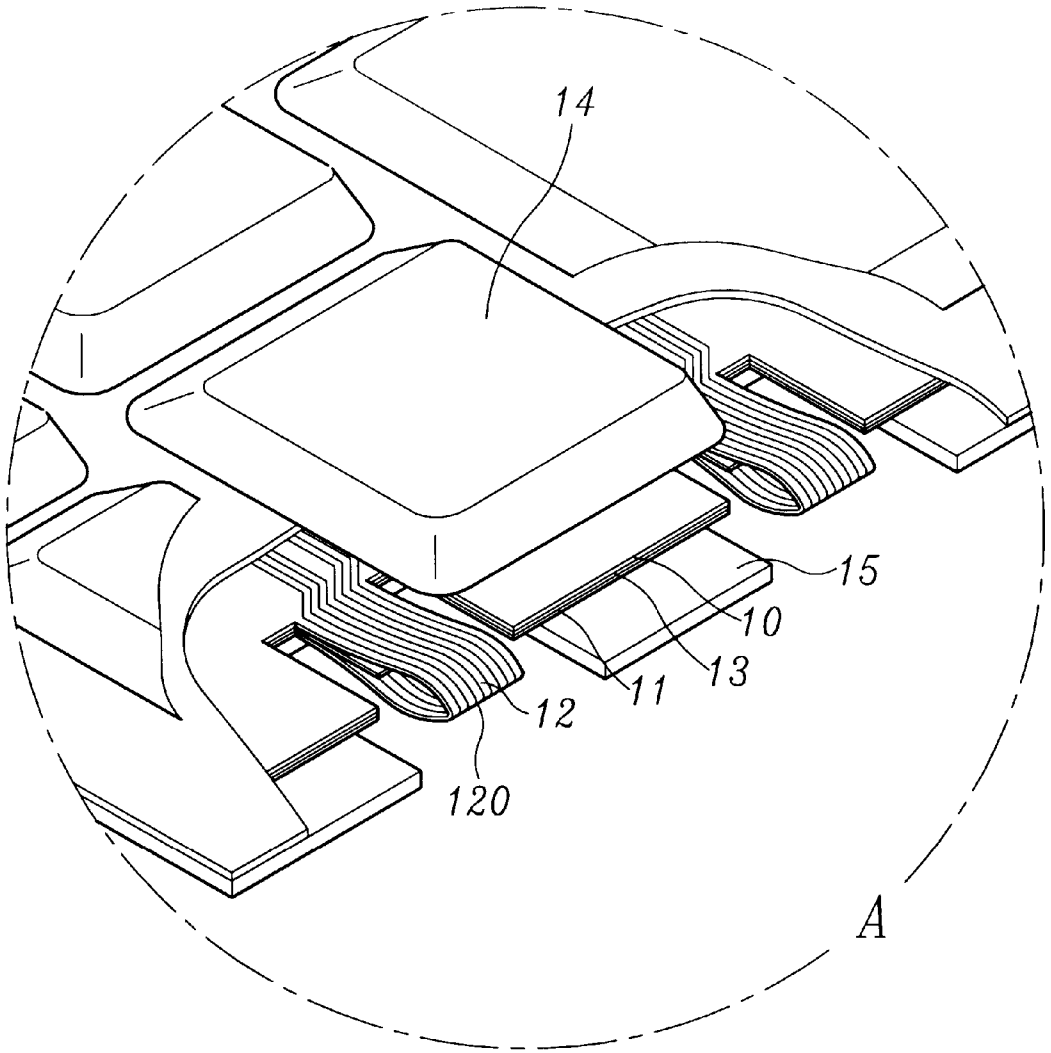
FIG. 1A PRIOR ART
FIG. 1A is the enlarged view of taken from a part in FIG. 1.
Figure 2:
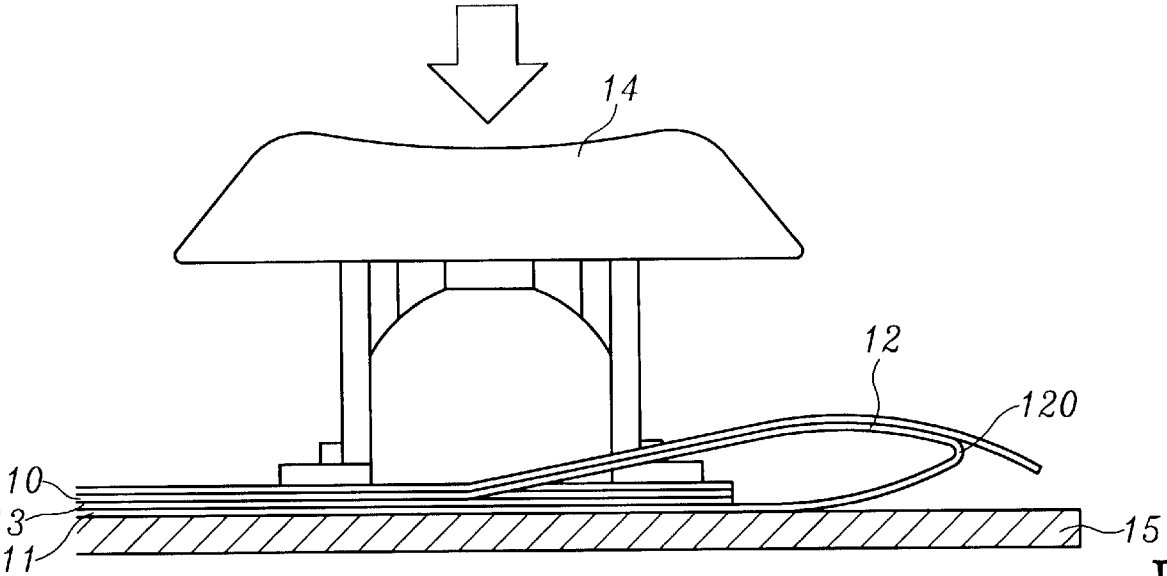
FIG.2 PRIOR ART
FIG. 2 is partial cross sectional view of a conventional flexible membrane circuit structure when the keyswitch is not pressed.
Figure 3:
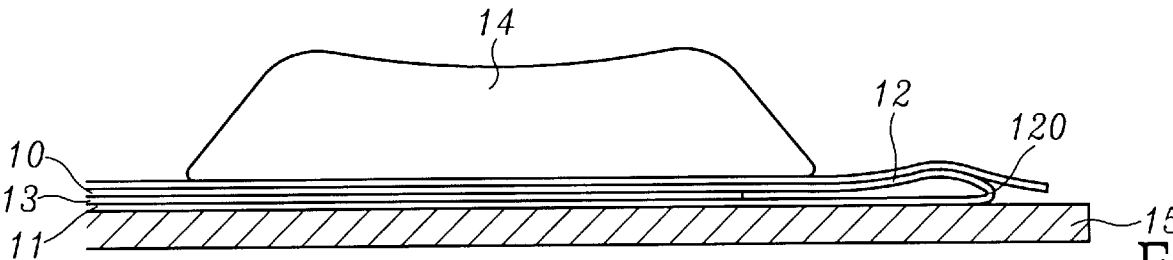
FIG.3 PRIOR ART
FIG. 3 is partial cross sectional view of a conventional flexible membrane circuit structure when the keyswitch is pressed.
Figure 4:
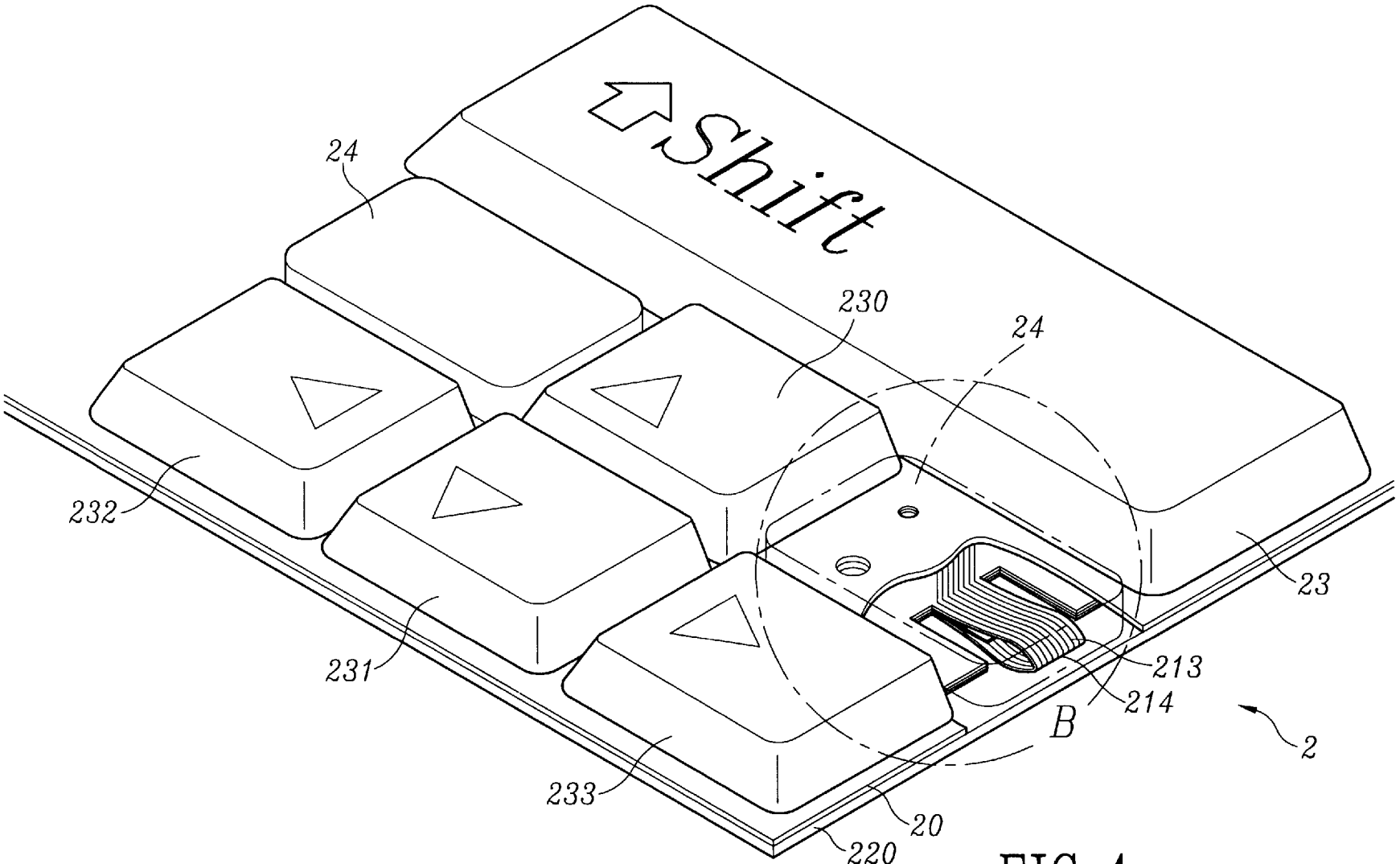
FIG. 4 is a partial perspective view of a flexible membrane circuit structure according to the present invention.
Figure 4A:
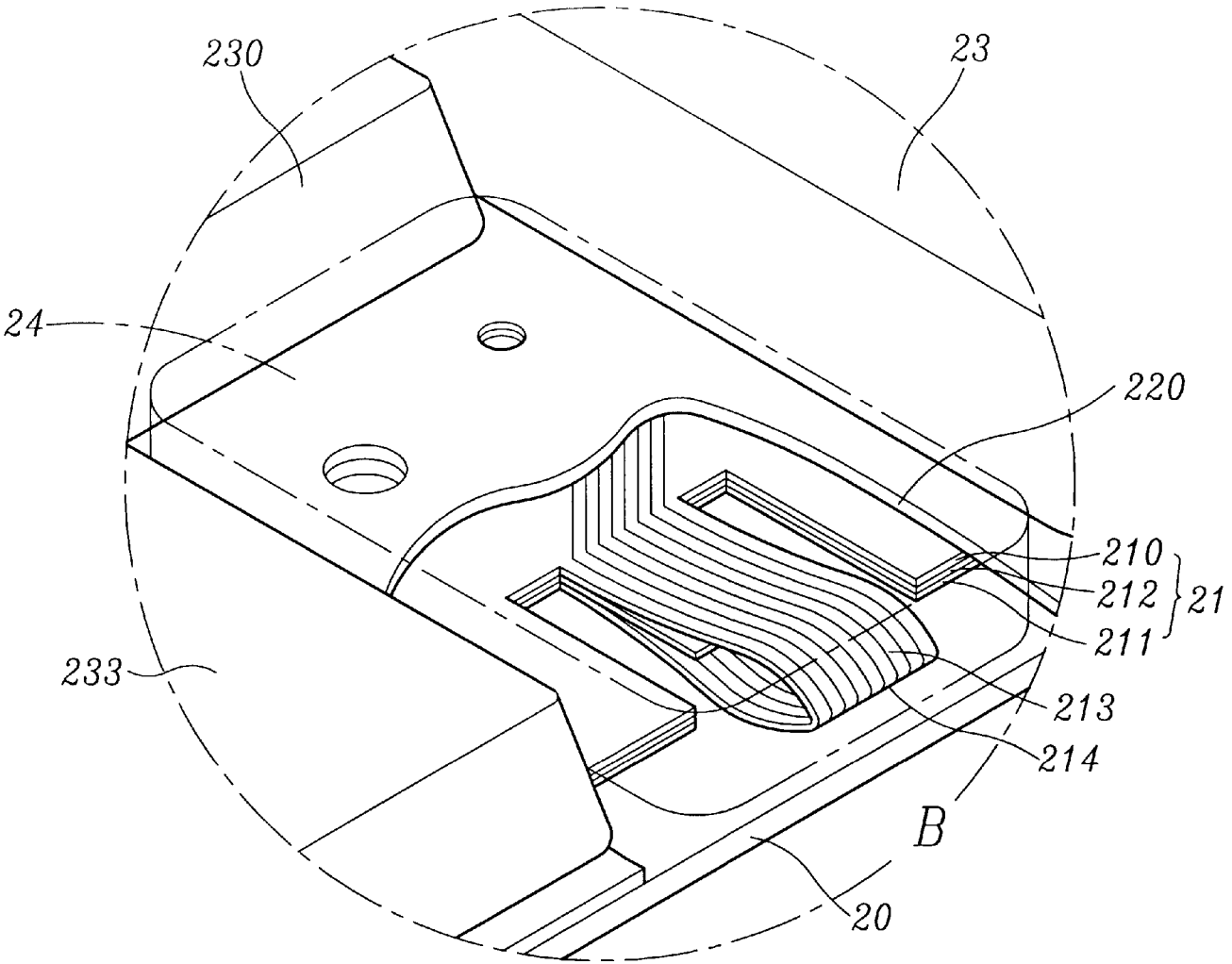
FIG. 4A is the enlarged view of taken from a part in FIG. 4.
Figure 5:
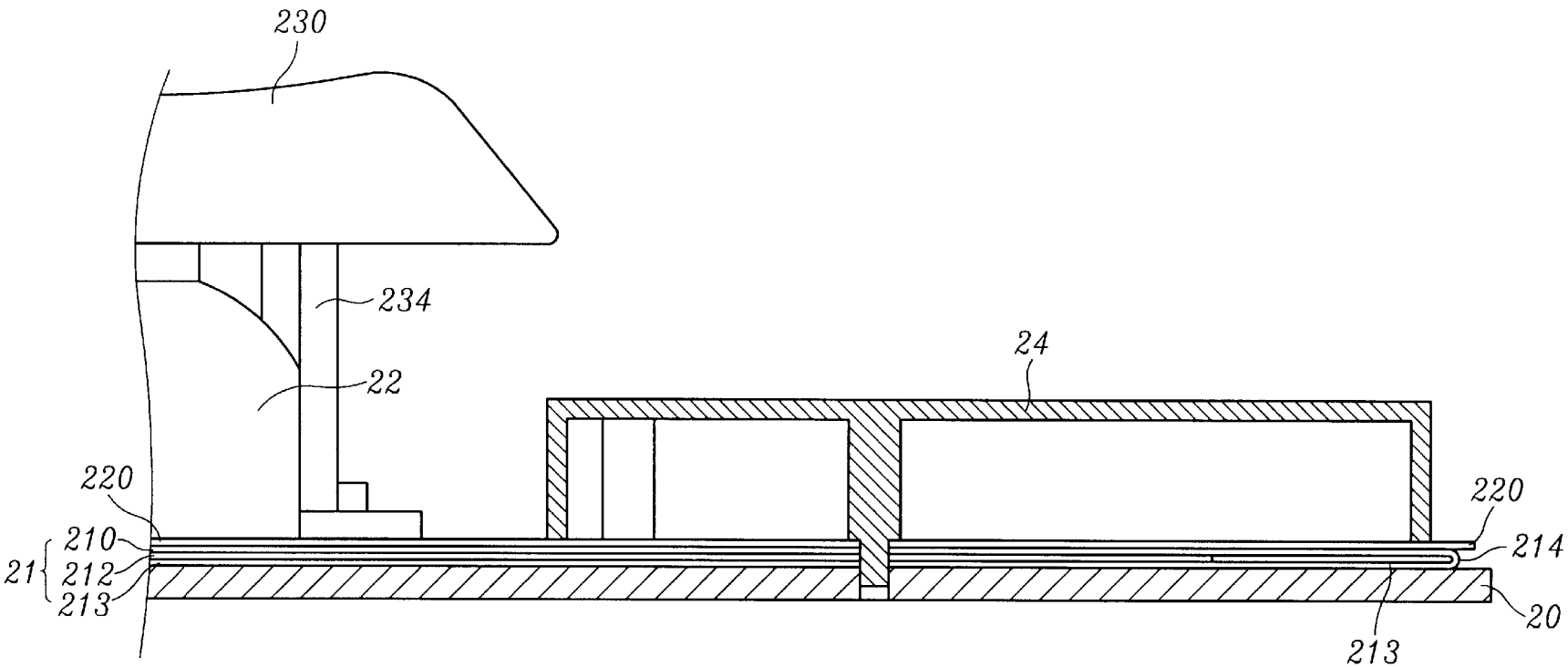
FIG. 5 is a partial cross sectional view showing the flexible membrane circuit structure according to the present invention housed by a fixed keyswitch.

With reference now to FIGS.4, 4A and 5, the present invention provides a flexible membrane circuit structure for low-profile keyboard, by which the cost is reduced and the endurance is enhanced. The keyboard 2 comprises a substrate 20, a flexible membrane circuit structure 21, a plurality of rubber cones 22, a plurality of movable keytops 23 and at least one fixed keytop 24.

The flexible membrane circuit structure 21 is arranged on the substrate 20 and comprises a double-layer structure composing an upper membrane circuit layer 210 and a lower membrane circuit layer 211. The upper membrane circuit layer 210 and the lower membrane circuit layer 211 have conductive contacts corresponding to those keytops. Moreover, in this embodiment, a spacer layer 212 is sandwiched between the upper membrane circuit layer 210 and the lower membrane circuit layer 211 to form a three-layer structure. Moreover, the spacer layer 212 has a plurality of through holes each corresponding to one conductive contact on the upper membrane circuit layer 210 and the lower membrane circuit layer 211. The plurality of movable keytops 23 are arranged on the upper membrane circuit layer 210 and each corresponding to one conductive contact. Alternatively, the plurality of movable keytops 23 can be mounted on a base plate 220 and then arranged on the upper membrane circuit layer 210, as shown in FIG. 5. The movable keytop 23 is mounted atop the rubber cone 22 through a lever frame 234 arranged on the substrate 20. The movable keytop 23 is guide by the lever frame 234 to collapse the rubber cone 22 such that the conductive contacts on the upper membrane circuit layer 210 and the lower membrane circuit layer 211 are electrically connected. Moreover, the fixed keytop 24 is arranged on marginal portion of the keyboard 2. For example, in the keyboard 2 of a notebook computer, a plurality of movable keytops 23 are located on the right bottom side of the keyboard 2. The movable keytops 23 are arranged in an inverse T-shape pattern and comprises an upper arrow key 230, a down arrow key 231, a left arrow key 232 and a right arrow key 233. Moreover, two fixed keytops 24 are arranged on both sides of the upper arrow key 230.

The flexible membrane circuit structure 21 comprises a large membrane circuit layer having two membranes printed with circuit trace and bridged by a plurality of folded plates 213. The total area of the large membrane circuit layer is about two times of the area of the keyboard 2. The larger membrane circuit layer is folded by bending the folded plates 213 such that an upper membrane circuit layer 210 and a lower membrane circuit layer 211 are provided. Moreover, the folded plates 213 are received within the fixed keytops 24.

The fixed keytops 24 are provided for filling the remaining space not occupied by the movable keytops 23 and essentially not movable. Therefore, the folded plates 213 received within the fixed keytops 24 can be prevented from breaking due to repeated striking of the movable keytops 23.

To sum up, the present invention provides a flexible membrane circuit structure for low-profile keyboard, wherein the folded plates are received within the fixed keytops to prevent the breaking of the folded plates.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A flexible membrane circuit structure for keyboard, comprising a substrate;

a membrane circuit structure arranged on said substrate and comprising an upper membrane layer and a lower circuit layer, each of the layers having conductive contacts, the conductive contacts on said upper membrane layer having a predetermined separation with corresponding conductive contacts on said lower membrane layer;

a plurality of movable keytops depressibly arranged on said substrate and each of the keytops corresponds to one of said conductive contacts;

at least one fixed keytop arranged on marginal location of said keyboard and being not depressible;

said upper membrane layer and said lower circuit layer being bridged by at least one folded plate such that said upper membrane layer electrically and mechanically connected with said lower circuit layer; said folded plate received within said at least one fixed keytop.

2. The flexible membrane circuit structure for keyboard as in claim 1, wherein said membrane circuit structure further comprising a spacer layer sandwiched between said upper membrane layer and said lower circuit layer.

3. The flexible membrane circuit structure for keyboard as in claim 1, wherein at least one of said upper membrane layer and said lower circuit layer is provided with a spacing body around said conductive contact.

4. The flexible membrane circuit structure for keyboard as in claim 1, further comprising a plurality of rubber cones arranged on said upper membrane layer and each of the cones corresponding to one of the conductive contacts on said upper membrane layer.

5. The flexible membrane circuit structure for keyboard as in claim 1, further comprising a base plate on said upper membrane layer, and a plurality of rubber cones arranged on said base plate and each of the cones corresponds to one of the conductive contacts on said upper membrane layer.

6. The flexible membrane circuit structure for keyboard as in claim 1, wherein said movable keytops are arranged in an inverse T-shape pattern and comprises an upper arrow key, a down arrow key, a left arrow key and a right arrow key, said at least one fixed keytop arranged on A side of said upper arrow key.

* * * * *